US011832661B1

(12) United States Patent
Wood et al.

(10) Patent No.: US 11,832,661 B1
(45) Date of Patent: Dec. 5, 2023

(54) PROTECTIVE TOP-OF-FOOT COVERING

(71) Applicants: Jennifer Lee Wood, Clearwater Beach, FL (US); Susan Deborah Sharp, Clearwater Beach, FL (US)

(72) Inventors: Jennifer Lee Wood, Clearwater Beach, FL (US); Susan Deborah Sharp, Clearwater Beach, FL (US)

( * ) Notice: Subject to any disclaimer, the term of this patent is extended or adjusted under 35 U.S.C. 154(b) by 233 days.

(21) Appl. No.: 17/410,318

(22) Filed: Aug. 24, 2021

Related U.S. Application Data

(60) Provisional application No. 63/089,966, filed on Oct. 9, 2020.

(51) Int. Cl.
*A41D 13/06* (2006.01)

(52) U.S. Cl.
CPC ..... *A41D 13/06* (2013.01)

(58) Field of Classification Search
CPC ..... A41D 13/06; D04B 1/26; D04B 1/108; A43B 3/02
See application file for complete search history.

(56) References Cited

U.S. PATENT DOCUMENTS

| | | | | |
|---|---|---|---|---|
| 5,867,838 | A | 2/1999 | Corry | |
| D499,807 | S * | 12/2004 | Stauffer | D24/192 |
| 7,107,626 | B1 * | 9/2006 | Andrews | A41B 11/004 2/239 |
| 9,038,201 | B2 * | 5/2015 | Lee | A61H 7/007 2/239 |
| 11,583,009 | B2 * | 2/2023 | Yehuda | A41B 11/002 |
| 11,613,832 | B2 * | 3/2023 | Giorgi | A41B 11/02 66/178 R |
| 2015/0374094 | A1 * | 12/2015 | Gift | A43B 23/081 36/94 |
| 2018/0184724 | A1 * | 7/2018 | Baker | A41B 11/08 |

FOREIGN PATENT DOCUMENTS

WO WO-2019195912 A1 * 10/2019

* cited by examiner

*Primary Examiner* — Tajash D Patel
(74) *Attorney, Agent, or Firm* — Weide & Miller, Ltd.

(57) ABSTRACT

A top of foot covering provides sun protection for the top of a wearer's foot and may be used when the wearer is barefoot or when wearing flip flops, sandals or shoes. The top of foot covering includes a covering, such as a fabric body, which extends over a top of a wearer's foot. The top of foot covering may be secured to the wearer's foot by one or more straps, such as toe and/or ankle straps.

19 Claims, 2 Drawing Sheets

PROTECTIVE TOP-OF-FOOT COVERING

RELATED APPLICATION DATA

The present application claims priority to U.S. Provisional Application Ser. No. 63/089,966, filed Oct. 9, 2020.

FIELD OF THE INVENTION

The present invention relates to footwear, and more particularly, to a top of foot covering providing sun protection which is specifically configured for use while performing outdoor activities such as paddle boarding, volleyball, running, surfing, wave runner, boating, fishing, kayaking, walking, biking, pedicure with or without a shoe, when open toes and bare bottom feet are preferred.

BACKGROUND OF THE INVENTION

Outdoor activities, and more specifically, those activities during the day when a person is exposed to sunlight. People are turning to paddle boarding, swimming and walking and running on beaches and parks for regular exercise and relaxation.

As the population is aging and more people are becoming and staying active later in their lives, more of them are concerned about skin cancer. The top of the foot is an often forgotten spot while applying SPF lotion.

SUMMARY OF THE INVENTION

Aspects of the invention comprise a foot covering, and particularly a top of the foot covering, as well as methods of using/wearing such a covering.

In one embodiment, a top of foot covering comprises a body having a top side and an opposing bottom side, an ankle opening, a top edge at the ankle opening and a bottom edge, the covering, when worn on a foot of a wearer having the body located on a top of the wearer's foot and having the bottom edge located above a sole of the foot, with an ankle of the wearer extending through said ankle opening, the top of foot covering further comprising a means for securing the body to the wearer's foot.

In one embodiment, the body of the top of foot covering comprises fabric.

In one embodiment, the means for securing comprises at least one toe-engaging band connected to the body.

In one embodiment, the means for securing further comprises an elastic band located at the top edge.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a protective foot covering, and preferably a top-of-foot covering. In general, the foot covering comprise a body or element which is configured to cover a top portion of the foot of a wearer, but not the bottom or sole of the foot of the wearer, thus enabling the wearer to wear the foot covering while bare foot or when wearing sandals or the like. The foot covering may further comprise a means for connecting the covering to the wearer.

Referring now more particularly to FIGS. 1-4, there is shown an illustrative embodiment of a foot covering 10 constructed in accordance with the teachings of the present invention. The illustrated foot covering 10 is advantageoiusly configured to be used bare foot or with sandal type footwear having an open toe area, such as flip flops. In one preferred embodiment, the foot covering 10 comprises a main body 12.

The main body 12 may be cut or otherwise formed from a piece of polyester fabric with one seam up the back of the foot covering which includes a certain amount of LYCRA® in order to enable the fabric to stretch. It will be appreciated however that any fabric of suitable strength and durability may be used. Moreover, while the invention will be described in connection with a certain exemplary configuration which has particular use with sandals or flip flops, it will be readily appreciated from the following description that the design may be varied to make the foot covering complementary to different types of sandals or other footwear, as well as bare feet.

Figure 3:
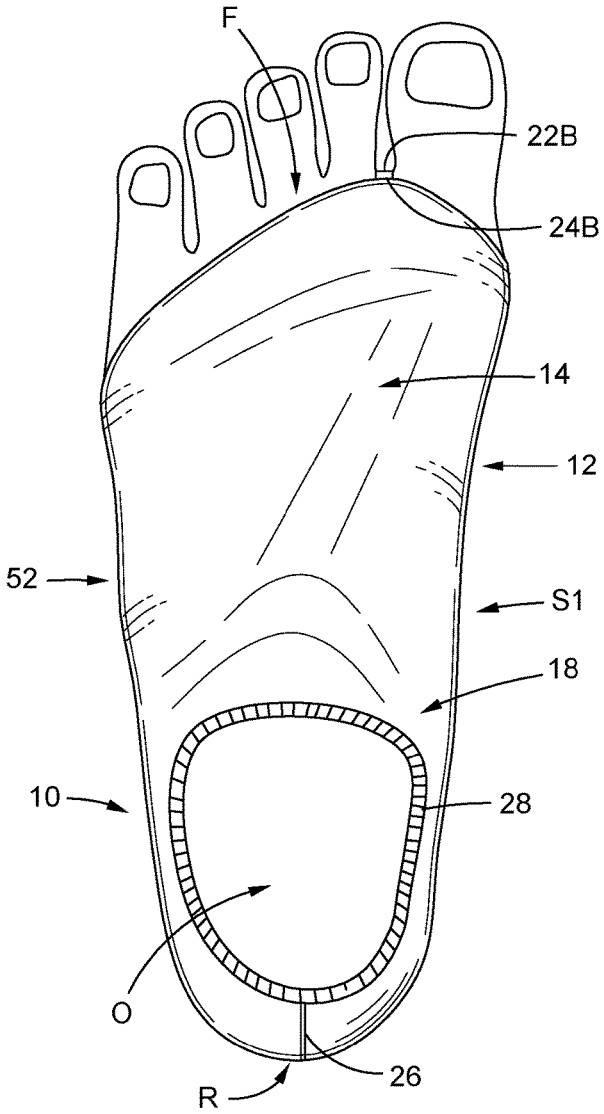
FIG. 3 is a top plan view of the protective foot covering of FIG. 1.

In order to help alleviate sun exposure issues and provide maximum breathable comfort, the main body 12 is configured to cover all or substantially all of the entire top surface of a foot, and the fabric or other material that forms the main body 12 is UV blocking. As shown in FIG. 3, the main body 12 may define or comprise a mid-foot covering portion 14. The mid-foot covering portion 14 may comprise a solid piece of fabric which is sized so as to cover the top of a wearer's foot, such as by spanning the entire width of a user's foot (i.e. in the lateral direction) and extending from his or her heel bone 26 to the toes (i.e. in the longitudinal direction), preferably without covering or extending over the bottom of the foot. In a preferred embodiment, the mid-foot covering portion 14 extends to the base of the toes, leaving the tops of the toes generally exposed. In other embodiments, the mid-foot covering portion 14 could extend over all or a portion of the toes.

In one embodiment, the foot covering 10 may also comprise an ankle portion 18. The ankle portion 18 may comprise a portion of the main body 12 which is configured to extend around the wearer's ankle. The ankle portion 18 may thus define an opening O through which the wearer may extend their foot (where the opening O might be defined by a cut in the body 12 of the foot covering 10 or might be formed by sewing or joining opposing portions of the foot covering 10 at ends thereof to form such an opening). For example, the foot covering 10 might be formed from two or more pieces of fabric that are connected or the like (such as two halves which are joined, such as in the longitudinal direction). In some embodiments, the mid-foot covering portion 14 and the ankle portion 18 might be separate elements which are or can be joined.

As will be appreciated, the foot covering 10 can be made in various sizes (widths and lengths) to ensure that the user's foot, and preferably the top of the foot, is substantially covered. In this way, the top of the foot, or at least at the midfoot portion thereof which is generally not protected from sun exposure while wearing sandals, is provided with maximum protection to help prevent sun exposure.

Figure 1:
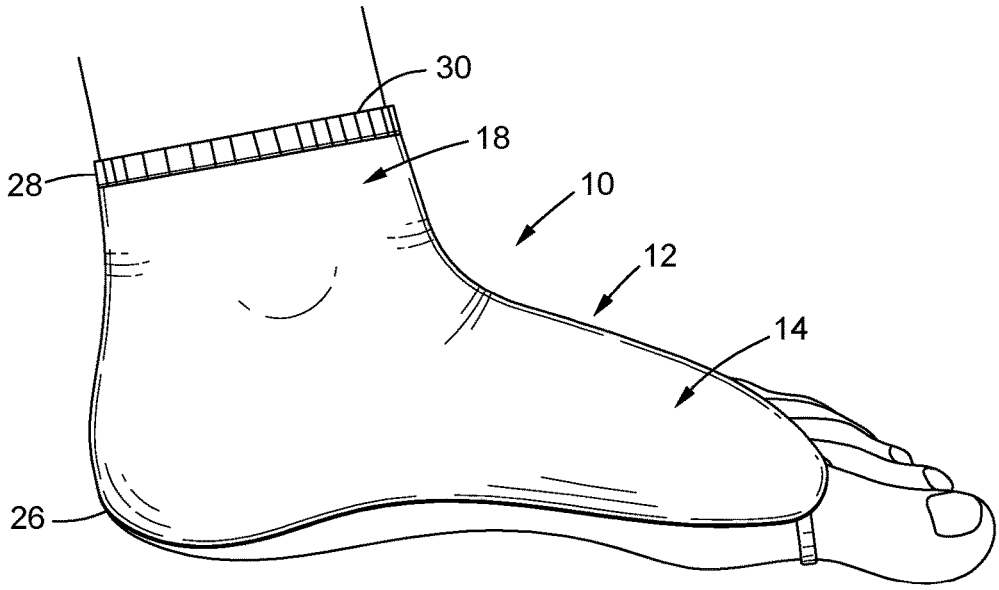
FIG. 1 is a side perspective view of the inner side of a protective foot covering in accordance with an embodiment of the invention.
Figure 2:
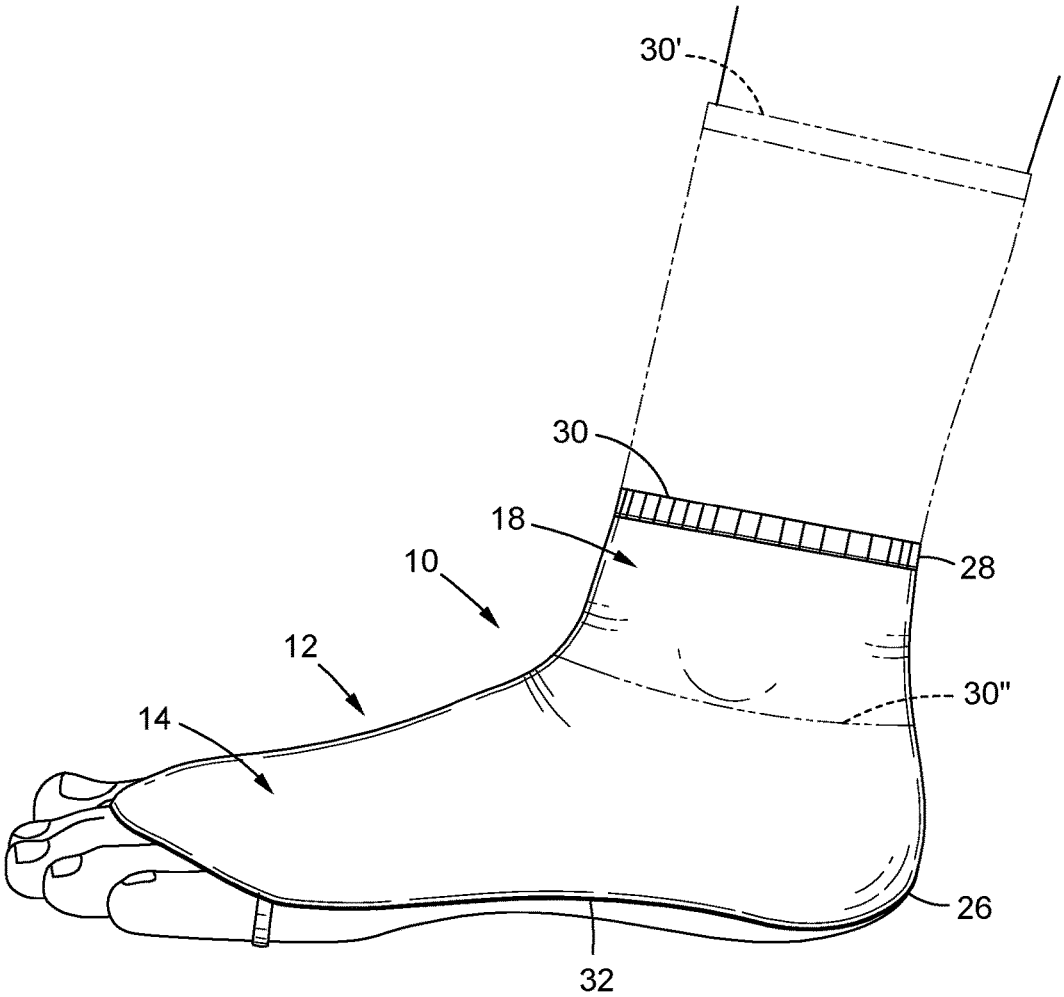
FIG. 2 is a side perspective view of the outer side of the protective foot covering of FIG. 1.
Figure 4:
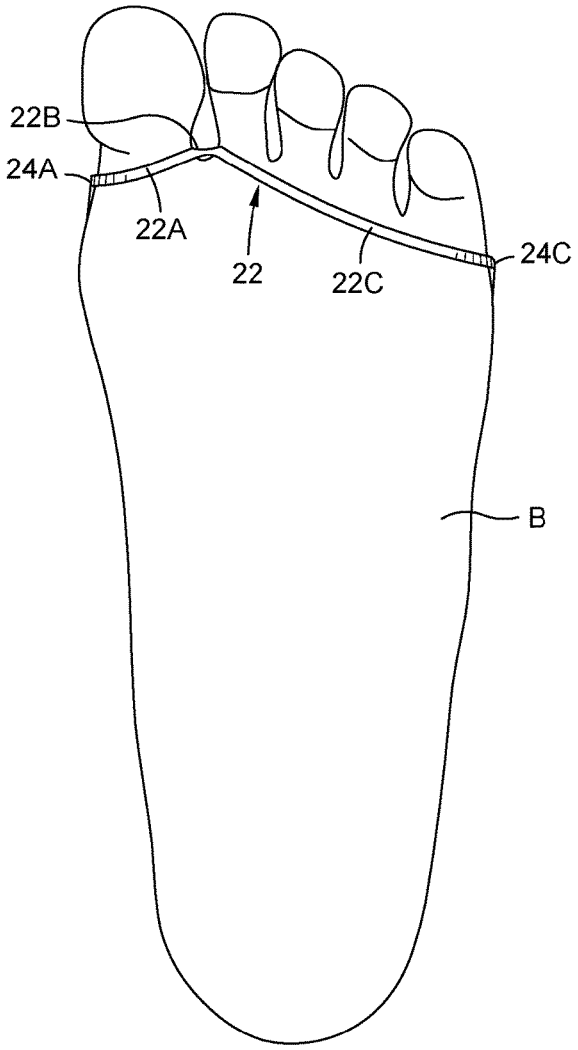
FIG. 4 is a bottom view of the protective foot covering of FIG. 1.

In the configuration illustrated, the foot covering 10 generally has a top side and a bottom side, wherein the top side faces outwardly from the wearer's foot and the bottom side faces the wearer's foot. The foot covering 10 also has a top edge 30 and a bottom edge 32. The top edge 30 is located at the wearer's ankle (such as at the ankle opening O), while the bottom edge 32 is located around (and preferably near the base of) the wearer's foot. Preferably, as indicated herein, the foot covering 10 covers the top of the wearer's foot and does not cover the bottom/sole of the wearer's foot. In such a configuration, as illustrated in FIGS. 1-3, the bottom edge 32 may extend along the top of the toes (generally at a front F of the foot covering 10), slightly above the sole of the foot along each side of the wearer's foot (at opposing side portions S1, S2 of the foot covering 10), to the rear of the foot, such as at the heel bone (at a rear R of the foot covering 10). However, in other configurations, the foot covering 10 may not extend so far downwardly along each side of the foot or far up the ankle, so as to primarily only cover the top of the midfoot. For example, as illustrated in FIG. 2, the foot covering 10 might extend further up the wearer's ankle, such as to the top edge 30'. As illustrated in FIG. 4, the foot covering 10 does not cover the bottom B (or sole) of the wearer's foot when worn.

Means are provided for connecting the foot covering 10 to the wearer, including for retaining the foot covering in position when worn, including during activity. In one embodiment, this means for connecting may comprise an ankle retaining element or portion, such as an elastic band 28 (or strap, drawstring or the like) for retaining the covering at the ankle (such as by extending around the wearer's ankle, such as at the top edge 30 of the foot covering 10). The band 28 might, for example, be associated with the fabric forming the body 12, such as by being a portion thereof or by being connected thereto (such as by being located in a pocket or fold formed from the fabric). The means may also or additionally comprise a midfoot portion 14 retaining portion or element, such as to prevent sliding and bunching. This means for connecting may comprise one or more bands 22 (or straps or the like). The one or more bands may (but need not be) be elastic and may be constructed from various materials, including being generally clear or transparent.

In one embodiment, the band 22 comprises a three-point attachment strap or band. As shown in FIGS. 1-4, this three-point attachment band 22 may be fixed or attached to the body 12, such as the underside mid-foot covering portion 14 of the foot covering 10 in three places: 1) at a point 24A at the bottom of the foot covering 10 at a first side S1 (adjacent to the big toe of the wearer when worn), 2) at a point 24B at the bottom of the foot covering 10 at a point at the front F thereof, between the opposing sides of the covering at a point where, when worn, the band 22 is positioned between the big toe and the second toe of the wearer, and 3) at a point 24C at the bottom of the foot covering 10 at the opposing side S2 of the foot covering 10 (adjacent to the pinky toe of the wearer when worn). In this configuration, the band 22 essentially has three portions: a first portion 22A which extends from the first side S1 of the body 12 and around the big toe to the second portion 22B, which second portion 22B extends from the first portion 22A next to the big toe of the wearer to the front F of the body 12 (whereby the first and second portions cooperate with the body 12 to generally define a loop through which the wearer's toe may be extended), and the third portion 22C which extends from the second portion 22B to the second side S2 of the body 12, such as under the other four toes of the wearer.

In this manner, when worn, the elastic band 28 maintains the rear portion of the foot covering 10 in position at the ankle of the wearer, and the mid-foot and forward or toe portion of the foot covering 10 is maintained in position by engagement of the band 22 with the wearer's big toe and foot as illustrated in FIG. 4.

Of course, the means for connecting might have other configurations. For example, the means for connecting or securing might further comprise a band which is connected to the covering at the mid-foot portion and which extends under the arch of the wearer's foot when the foot covering 10 is worn. The means for securing, such as the one or more bands, might also be configured to engage other of the wearer's toes, including by comprising or defining a loop for encircling other toes.

As another example, the foot covering 10 might only comprise the mid-foot covering portion 14. A strap or the like might be connected to the mid-foot portion 14 for extension around the wearer's ankle in order to keep the rear portion of the foot covering 10 in place. In yet another embodiment, the mid-foot covering portion 14 might terminate at the base of the wearer's ankle, such as at a top edge 30" as illustrated in dotted lines in FIG. 2. In such a configuration, the mid-foot covering portion 14 might define the opening O for extension of the wearer's foot therethrough, or the mid-foot covering portion 14 might define two flaps which the user can extend around the rear of their foot and which can be joined (such as with snaps, hook and loop fasteners, etc.).

FIGS. 1-4 illustrate a top of foot covering 10 for the left foot of a wearer. It will be appreciated that a top of foot covering 10 for the right foot of a wearer may be similarly configured, such as with the features thereof in reverse orientation (such as by having the band or strap 22 be formed on the left side thereof for engagement with the big toe of the right foot, etc.).

From the foregoing, it can be seen that the foot covering 10 of the present invention provides advantages such as added sun (UV) protection while not losing the comfort or open feeling of bare foot, preferably by comprising a top-of-foot covering which does not cover the bottom/sole of the wearer's foot. The foot covering 10 is further designed to be securely retained in position, including during activity. The foot covering 10 can be formed of decorative fabric or include other aesthetic features, so as to form a fashion accessory as well as providing sun protection. The foot covering 10 can also protect the top of the wearer's foot in other manners, including from abrasion and the like.

Another embodiment of the invention comprises a method of using, such as wearing, a foot covering of the invention. Relative to the embodiment illustrated in FIGS. 1-4, a user may place their foot through the opening O in the foot covering 10. The user may then engage the means for securing, such as by placing their big toe through the loop formed by the band or strap 22, and by locating their remaining toes between the body 12 and the band or strap 22, such as illustrated in FIG. 4. The user may then orient the body 12, such as by moving it slightly from side to side and/or front to back, in order to ensure that it is aligned over the top of their foot.

As indicated, the wearer may then wear the top of foot covering 20 while barefoot, but may also wear the top of foot covering 20 with sandals, flip-flops or other footwear. Of course, the wearer preferably wears a top of foot covering 20 on each of their two feet.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A top of foot covering comprising:

a body having a top side and an opposing bottom side, an ankle opening, a top edge at said ankle opening and a bottom edge, said top of foot covering when worn on a foot of a wearer having said body located on a top of the wearer's foot and having the bottom edge located above a sole of the foot, with an ankle of the wearer extending through said ankle opening; and a band connected to the body and being configured to extend under toes of the foot in order to secure the body to the top of the wearer's foot so that the body does not extend under said sole of the foot.

2. The top of foot covering in accordance with claim 1, wherein said body comprises fabric.

3. The top of foot covering in accordance with claim 1, wherein said body has a front and first and second opposing sides, and said band is connected to said body at said first side, said front and said second side.

4. The top of foot covering in accordance with claim 1, wherein said band is configured to define, in conjunction with said body, an opening for accepting a toe of said wearer.

5. The top of foot covering in accordance with claim 1, wherein said top of foot covering comprises a mid-foot engaging portion and an ankle portion.

6. The top of foot covering in accordance with claim 1, wherein said band comprises a first portion, a second portion and a third portion.

7. A top of foot covering comprising:

a body having a top side and an opposing bottom side, an ankle opening, a top edge at said ankle opening and a bottom edge, said top of foot covering when worn on a foot of a wearer having said body located on a top of the wearer's foot and having the bottom edge located above a sole of the foot, with an ankle of the wearer extending through said ankle opening; and a band connected to the body for securing the body to the wearer's foot, wherein said band comprises a first portion, a second portion and a third portion, and wherein said first portion is connected to said body and said second portion, said third portion is connected to said body and said second portion, and said second portion is connected to said first and second portions and said body.

8. The top of foot covering in accordance with claim 7, wherein said body has a front and first and second sides, said first portion is connected to said body at said first side, said second portion is connected to said body at said front and said third portion is connected to said body at said second side.

9. A top of foot covering comprising:

a body having a front, a rear disposed opposite the front, a top side and an opposing bottom side, an ankle opening and a bottom opening, a top edge at said ankle opening and a bottom edge defining said bottom opening, said bottom edge extending from the front of said body to the rear of said body, said covering when worn on a foot of a wearer having said body located on a top of the wearer's foot and having the bottom edge located above a sole of the foot such that a bottom of the wearer's foot extends through said bottom opening, with an ankle of the wearer extending through said ankle opening, and at least one band connected to said body and cooperating with said body to define an opening for accepting at least one toe of a wearer therethrough, said top edge having a central axis, and said bottom edge being disposed substantially perpendicular to the central axis.

10. The top of foot covering in accordance with claim 9, wherein said body further has a first side and a second side and said at least one band has a first portion connected to said first side of said body and a second portion connected to said front of said body.

11. The top of foot covering in accordance with claim 9, wherein said opening is configured to accept a big toe of a wearer.

12. The top of foot covering in accordance with claim 9, wherein said body comprises fabric.

13. The top of foot covering in accordance with claim 9, further comprising an elastic strap associated with said body at said ankle opening.

14. The top of foot covering in accordance with claim 1, wherein said body further has a front, a rear disposed opposite the front, and a bottom opening defined by said bottom edge, wherein said bottom edge extends from the front of said body to the rear of said body, wherein said bottom edge is located above the sole of the foot such that a bottom of the wearer's foot extends through said bottom opening, and wherein said top edge has a central axis, and said bottom edge is disposed substantially perpendicular to the central axis.

15. The top of foot covering in accordance with claim 7, wherein the band is configured to extend under toes of the foot in order to secure the body to the top of the wearer's foot so that the body does not extend under a ball of the foot.

16. The top of foot covering in accordance with claim 7, wherein said body further has a front, a rear disposed opposite the front, and a bottom opening defined by said bottom edge, wherein said bottom edge extends from the front of said body to the rear of said body, wherein said bottom edge is located above the sole of the foot such that a bottom of the wearer's foot extends through said bottom opening, and wherein said top edge has a central axis, and said bottom edge is disposed substantially perpendicular to the central axis.

17. The top of foot covering in accordance with claim 9, wherein said bottom edge has a first side and a second side, said first side extending along a first side of the wearer's foot and the second side extending along the second side of the wearer's foot when worn.

18. The top of foot covering in accordance with claim 17, wherein said first and second sides of said bottom edge are connected only by said at least one band.

19. The top of foot covering in accordance with claim 9, wherein said body does not extend over said sole of said wearer's foot.

* * * * *